US007690934B2

(12) United States Patent
Riner

(10) Patent No.: US 7,690,934 B2
(45) Date of Patent: Apr. 6, 2010

(54) MOUNTING APPARATUS FOR AN ELECTRICAL DISTRIBUTION HARNESS ASSEMBLY

(75) Inventor: Ray H. Riner, Fort Wayne, IN (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

(21) Appl. No.: 12/609,433

(22) Filed: Oct. 30, 2009

(65) Prior Publication Data

US 2010/0048050 A1 Feb. 25, 2010

Related U.S. Application Data

(63) Continuation of application No. 11/753,236, filed on May 24, 2007.

(51) Int. Cl.
*H01R 13/17* (2006.01)
*H01R 43/24* (2006.01)

(52) U.S. Cl. ..... 439/215; 29/883

(58) Field of Classification Search ..... 439/215, 439/216, 606; 29/841, 883, 858
See application file for complete search history.

(56) References Cited

U.S. PATENT DOCUMENTS

| | | | |
|---|---|---|---|
| 5,013,252 | A | 5/1991 | Nienhuis et al. |
| 5,158,472 | A | 10/1992 | Juhlin |
| 5,334,044 | A | 8/1994 | Falossi et al. |
| 5,383,318 | A | 1/1995 | Kelley et al. |
| 5,728,970 | A | 3/1998 | Karst et al. |
| 6,235,988 | B1 | 5/2001 | Karst et al. |
| 6,329,591 | B2 | 12/2001 | Karst et al. |
| 6,835,081 | B2 | 12/2004 | Plattner et al. |
| 6,910,903 | B2 | 6/2005 | Kondas |
| 6,991,485 | B2 | 1/2006 | Plattner et al. |
| 7,144,264 | B2 | 12/2006 | Kochanski |
| 7,461,484 | B2 | 12/2008 | Battey et al. |
| 2006/0024996 | A1 | 2/2006 | Johnson et al. |

*Primary Examiner*—Briggitte R Hammond
(74) *Attorney, Agent, or Firm*—Taylor & Aust, PC

(57) ABSTRACT

An electrical distribution harness assembly configured for coupling with a modular wall panel includes at least one electrical connector including a body and an elastic clip bracket configured for snap-fitting to the modular wall panel, the body forming an overmolded connection with the elastic clip bracket.

15 Claims, 7 Drawing Sheets

MOUNTING APPARATUS FOR AN ELECTRICAL DISTRIBUTION HARNESS ASSEMBLY

CROSS REFERENCE TO RELATED APPLICATIONS

This is a continuation of U.S. patent application Ser. No. 11/753,236, entitled "MOUNTING APPARATUS FOR AN ELECTRICAL DISTRIBUTION HARNESS ASSEMBLY", filed May 24, 2007, which is incorporated herein by reference.

BACKGROUND OF THE INVENTION

1. Field of the Invention

The present invention relates to electrification of modular wall panels, and, more particularly, to a mounting apparatus for an electrical distribution harness assembly of a modular wall panel.

2. Description of the Related Art

Modular office wall panels are used to separate work stations which require electrical power. Raceways within the wall panels are often used to carry electrical circuitry, hidden from view, to the work stations. One proposal has suggested that the electrical circuitry can be transported in a partition panel using a powerway which is coupled with the panel using a fastener. This proposal requires using tools and is, thus, often undesirable.

Another proposal has suggested using an electrical distribution assembly including a channel connected to a connector block. A plurality of plates are also connected to the channel and are used to fasten a plurality of electrical outlets with the connector block. The projections extend from respective plates and connect with a bracket associated with a partition panel. At least one projection includes a lateral projection extending laterally from a respective plate. Another projection includes lips and a resilient retainer. After placing the lateral projection within an opening of the bracket, the assembly is rotated sideways such that the lips projection is placed within another opening. The resilient retainer causes the lips to engage the top of the bracket, thereby preventing relative movement between the assembly and the bracket. An example of this type of mounting arrangement for an electrical distribution harness is disclosed in U.S. Pat. No. 5,728,970, which is assigned to the assignee of the present invention.

While this latter proposal couples an electrical distribution harness assembly to a partition panel in a way that does not require the installer to use tools, the latter proposal requires a channel fastened to plates which include the mounting projections. The latter proposal further requires using different types of projections and an accompanying resilient member to secure the harness assembly to the bracket.

What is needed in the art is a mounting apparatus of an electrical distribution harness assembly where the mounting apparatus does not require a fastener for mounting to a wall panel, does not involve a multiplicity of parts, and is simple to use and manufacture.

SUMMARY OF THE INVENTION

The present invention provides a snap-fit mounting apparatus of an electrical distribution harness assembly where the snap-fit mounting apparatus does not require a fastener for mounting to a wall panel, does not involve a multiplicity of parts, and is simple to use and manufacture.

The invention in one form is directed to an electrical distribution harness assembly configured for coupling with a modular wall panel. The electrical distribution harness assembly includes at least one electrical connector including an elastic clip bracket configured for snap-fitting to the modular wall panel.

The invention in another form is directed to a method of mounting an electrical distribution harness assembly to a modular wall panel. The method includes the steps of providing, mounting, and securing. The providing step provides at least one electrical connector including an elastic clip bracket. The mounting step mounts an end of the elastic clip bracket to a mounting feature associated with the modular wall panel. The securing step secures the end of the elastic clip bracket to the mounting feature.

The invention in yet another form is directed to a method of manufacturing an electrical distribution harness assembly configured for coupling with a modular wall panel. The method includes the steps of forming and encapsulating. The forming step forms an elastic clip bracket configured for snap-fitting to the modular wall panel. The encapsulating step encapsulates at least a portion of the elastic clip bracket in an electrical connector.

An advantage of the present invention is ease of installation, the installation being quick and accomplished without fasteners and tools.

Another advantage is that the mounting clip can be insert molded with an electrical connector block, thereby minimizing the number of separate parts to be coupled together.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
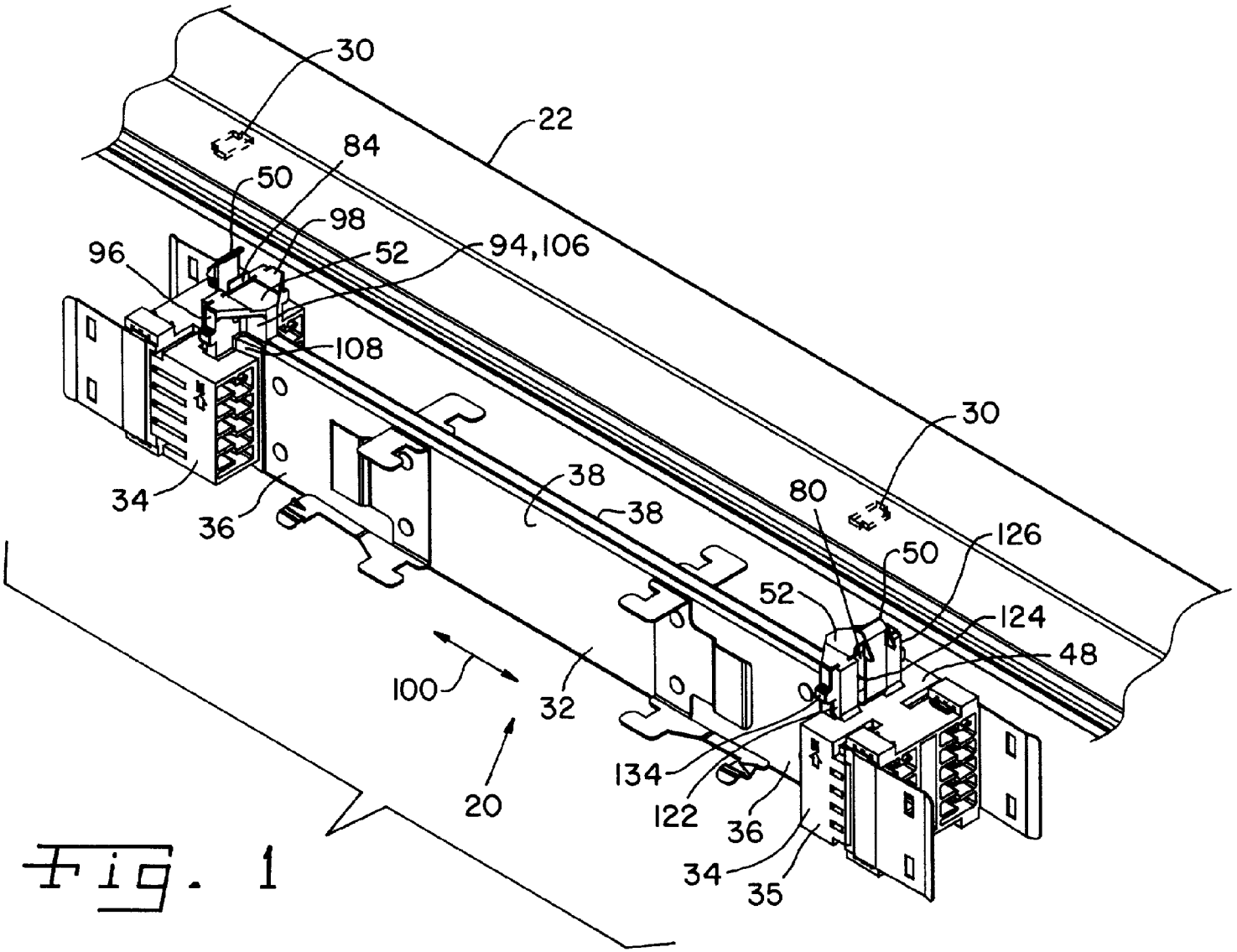
FIG. 1 is a perspective view of an electrical distribution harness assembly of the present invention exploded from a rail of a modular wall panel.
Figure 2:
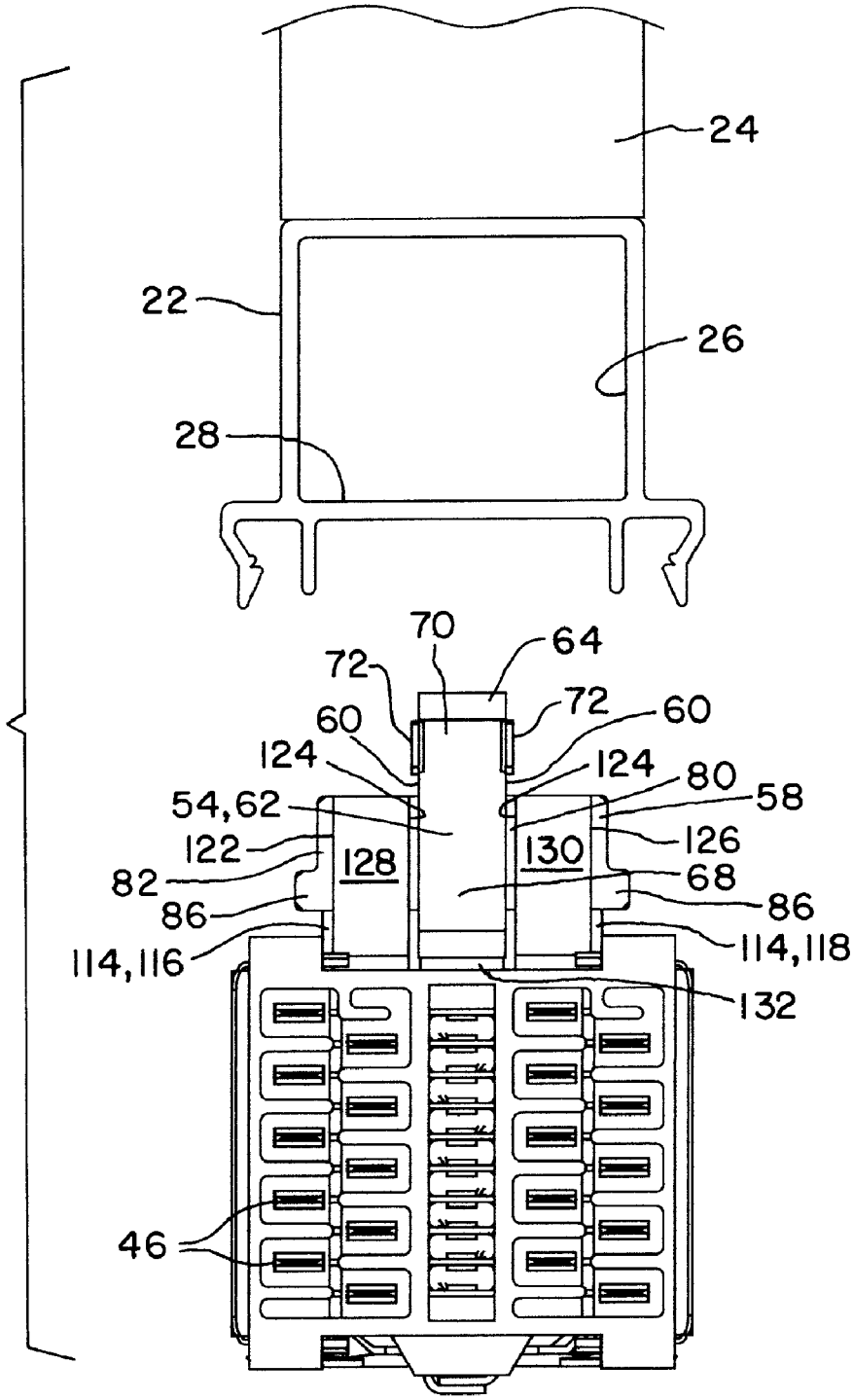
FIG. 2 is a front view of an electrical connector block of the electrical distribution harness assembly and rail of FIG. 1, including a modular wall panel.

Referring now to the drawings, and more particularly to FIGS. 1-4, there is shown the invention in one form directed to an electrical distribution harness assembly 20 which can mount on a horizontal rail 22 of a modular wall panel 24. Rail 22 generally includes a square-shaped channel 26 having a bottom wall 28. Bottom wall 28 can include a mounting feature 30 such as at least two mounting holes, which can be T-slots. Alternatively, another type of mounting feature 30 can be associated with modular wall panel 24, the other type of mounting feature including at least one hook. Harness 20 can couple with bottom wall 28 via holes 30 or can couple with modular wall panel 24 via another mounting feature 30 associated with modular wall panel 24.

Figure 3:
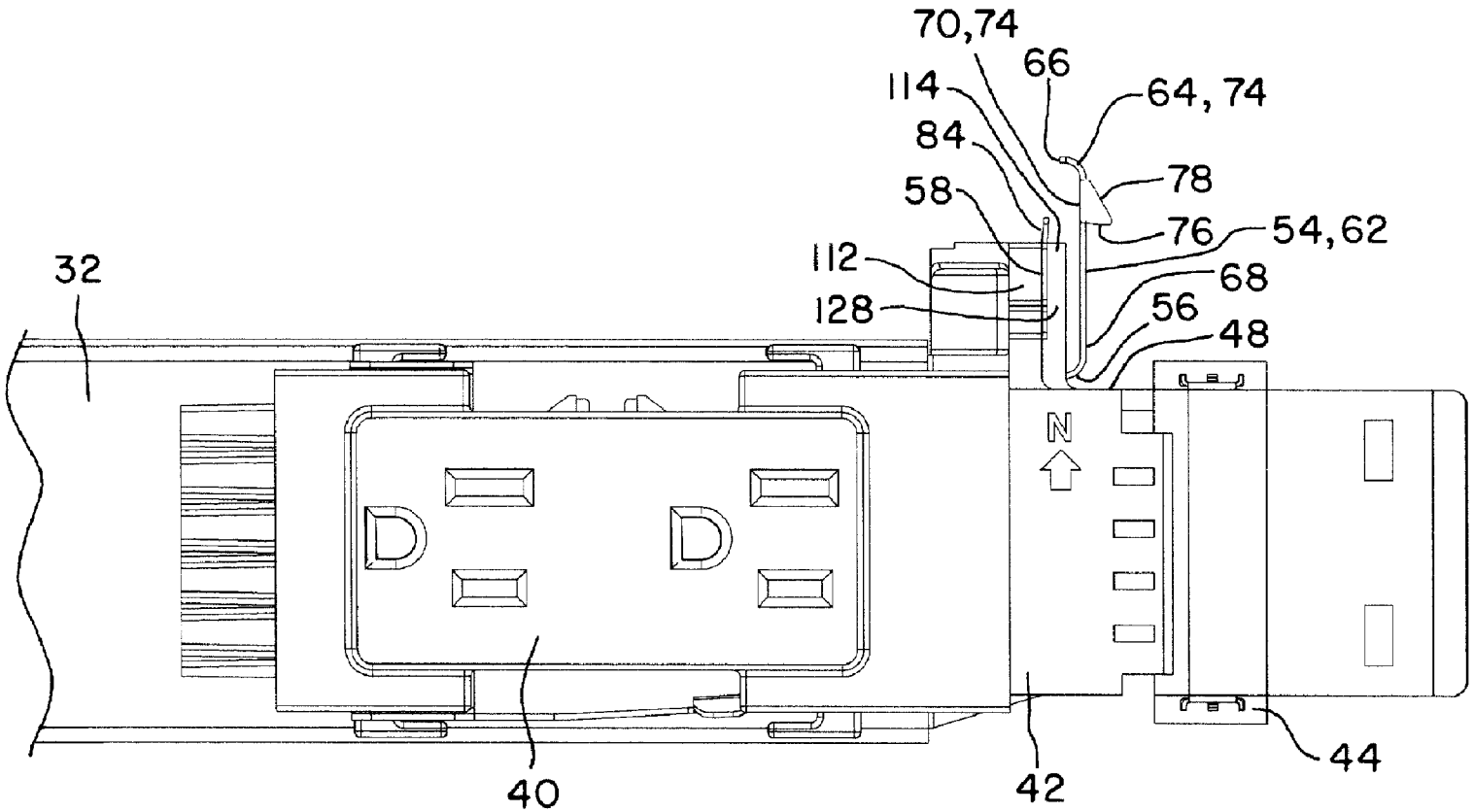
FIG. 3 is a fragmentary, side view of the electrical distribution harness assembly of FIG. 1, the electrical distribution harness assembly including a receptacle.
Figure 4:
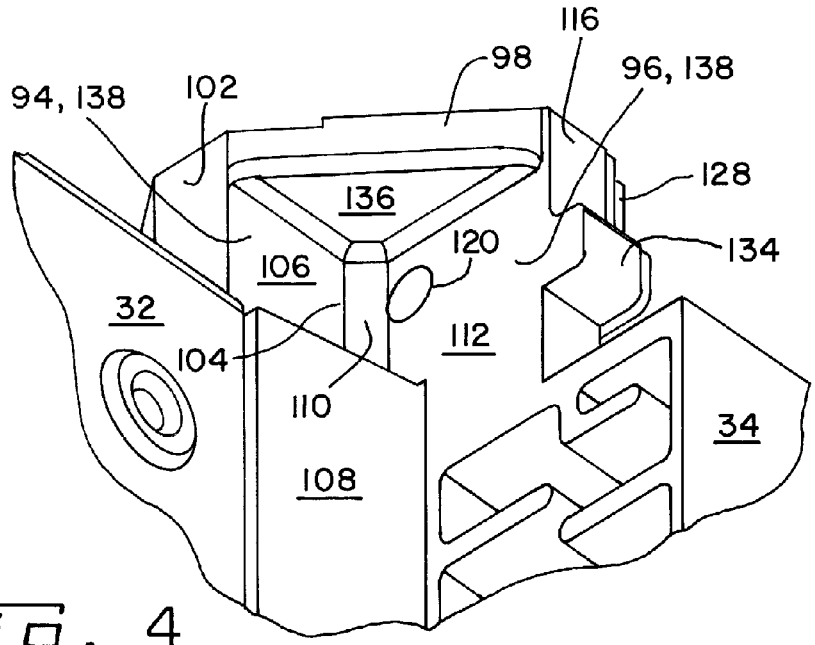
FIG. 4 is a fragmentary, perspective view of the electrical distribution harness assembly of FIG. 1.
Figure 6:
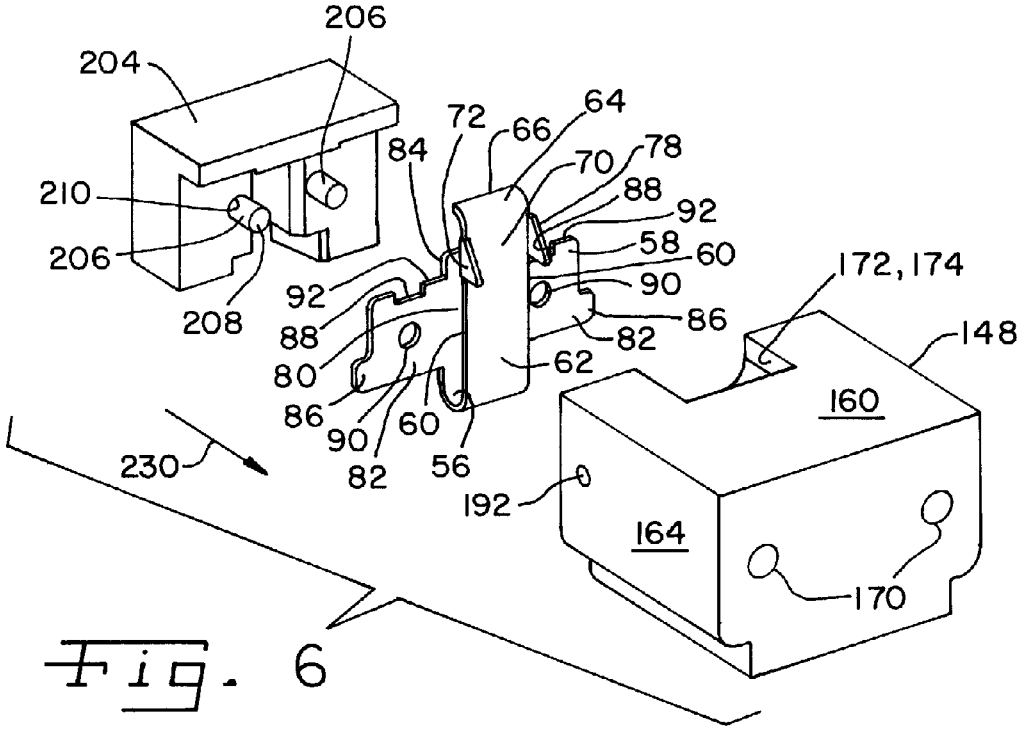
FIG. 6 is an exploded, perspective view of the clip insert, the elastic clip bracket, and the back-supporting insert of FIG. 5.

Harness 20 generally includes a wireway 32 and two electrical connector blocks 34 (also called electrical connectors). Wireway 32 carries a plurality of conductors (not shown) inside wireway 32. Wireway 32 includes two opposing ends 36 and two opposing sides 38. Each end of wireway 32 is coupled with one electrical connector block 34. Wireway 32, thus, extends between two electrical connector blocks 34. Each end 36 can be riveted to electrical connector block 34. Each side 38 of wireway 32, together with two electrical connector blocks 34, can serve as a mounting platform for two electrical receptacles 40. Thus, while FIG. 3 shows only one receptacle 40 mechanically and electrically coupled with harness 20, wireway 32 and electrical connector blocks 34 in FIG. 1 could accommodate four receptacles 40, two receptacles 40 on each side 38 of wireway 32 fitted in each electrical connector 34.

Electrical connector block 34 includes a body 35, a first end 42 facing wireway 32, a second end 44 facing away from wireway 32, a plurality of electrical terminals (not shown) on first end 42, a plurality of electrical terminals 46 on second end 44 (FIG. 2), and a top side 48. The electrical terminals on both ends 42, 44 of wireway 32 generally extend in a longitudinal direction 100 of wireway 32.

Top side 48 of electrical connector block 34 includes an elastic clip bracket 50 and a mounting tab 52, clip bracket 50 being mounted to tab 52. Clip bracket 50 serves to snap-fit electrical connector block 34, and thus harness 20, to rail 22 via hole 30 or to modular wall panel 24 via another type of mounting feature. Clip bracket 50 can be pre-formed from metal (such as stainless steel) and subsequently injection insert molded (overmolded) with tab 52, which can be formed integral with electrical connector block 34 (as shown in the figures) or, alternatively, formed separately from electrical connector block 34 and then fastened to block 34. According to another alternative embodiment of the present invention, clip bracket 50 can be fastened to tab 52 such as by riveting. Insert molding and overmolding are used interchangeably herein; where one term is used, it is understood to mean the other term as well.

Clip bracket 50 includes a generally vertical arm 54, a generally U-shaped bottom section 56, and a generally vertical flat plate 58 coupled with arm 54 using U-shaped section 56. Arm 54, U-shaped section 56, and flat plate 58 can be formed integral relative to one another (as shown in the drawings) or, alternatively, formed separately and coupled together.

Arm 54 includes two longitudinal sides 60, a generally vertical section 62, and an upper curved section 64 having a terminating end 66. Longitudinal sides 60 run from U-shaped section 56 to terminating end 66 and, thus, span vertical section 62 and upper curved section 64. Longitudinal sides 60 are generally parallel to one another.

Vertical section 62 of arm 54 includes a lower end 68 and an upper end 70. Lower end 68 can be formed integral with U-shaped section 56. Upper end 70 can be formed integral with upper curved section 64. Upper end 70 includes at least one projection 72 but can include a plurality of projections 72, such as two projections 72 (as shown in the figures). Each projection 72 can be formed integral with upper end 70. Projections 72 can serve to retain a mounting end 74 of arm 54 in mounting hole 30 and, thus, couple elastic clip bracket 50 with rail 22 of modular wall panel 24. One projection 72 is coupled with and projects from one longitudinal side 60 of arm 54, while the other projection 72 is coupled with and projects from the other longitudinal side 60 of arm 54. Projections 72 can be generally shaped as a triangle, square, and/or rectangle. With a triangular shape, projection 72 can include a generally horizontal bottom edge 76 which is generally perpendicular to longitudinal side 60. Each projection 72 can also include an upwardly facing edge 78 which generally extends between longitudinal side 60 and bottom edge 76 of projection 72; that is, upwardly facing edge 78 serves generally as the hypotenuse of triangular projection 72.

Upper curved section 64 of arm 54 can serve as a thumb-depressor and/or an insertion facilitator during installation. That is, upper curved section 64 is configured for being inserted in mounting hole 30 of modular wall panel 24. Upper curved section 64 can be positioned above and proximate at least one projection 72. More specifically, upper curved section 64 can begin at or just above projections 72, proceed to curve inwardly toward wireway 32, and terminate at terminating end 66. Upper curved section 64 of each clip bracket 50 of harness 20 curves toward each other, as shown in FIG. 1. Using upper curved section 64 as a thumb-depressor and/or an insertion facilitator, arm 54 can be depressed inwardly toward wireway 32 during installation and can snap back after projections 72 have been fully inserted into mounting hole 30.

U-shaped section 56 serves as a transition section, transitioning from arm 54 to flat plate 58. U-shaped section 56, like the remainder of clip bracket 50, is elastic and allows arm 54 to move towards and away from flat plate 58. U-shaped section 56 includes longitudinal sides which are continuous with longitudinal sides 60 of arm 54 and can have substantially the same width therebetween as the width between longitudinal sides 60 of arm 54. Alternatively, the width between longitudinal sides of U-shaped section 56 can be greater or less than the width between longitudinal sides 60 of arm 54. Additionally, while longitudinal sides of U-shaped section 56 can generally be parallel relative to one another, longitudinal sides of U-shaped 56 section may not be parallel. For example, the width between longitudinal sides of U-shaped section 56 may widen running from arm 54 to flat plate 58. U-shaped section 56 can be integral with arm 54 and flat plate 58.

Figure 8:
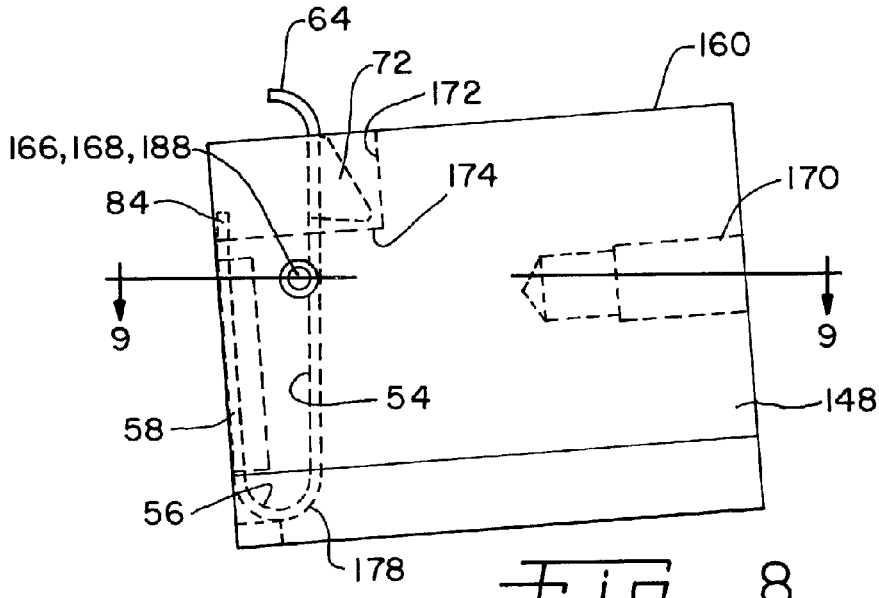
FIG. 8 is a side view of the clip insert showing portions of the clip insert and the elastic clip bracket in broken lines.

Flat plate 58 includes a center section 80 (spine) and two wing sections 82 (wings), spine 80 being between wings 82. Spine 80 includes an upper terminating end 84 which can be lower than terminating end 66 of upper curved section 64. Spine terminating end 84 can terminate at approximately the same level (elevation) as bottom edge 76 of triangular projection 72 and can be inserted at least partially in hole 30. Spine terminating end 84 can lean towards arm 54 and may not be coplanar with remaining portions of flat plate 58. Thus, flat plate 58, less spine upper terminating end 84, may or may not be parallel relative to vertical section 62 of arm 54. FIG. 8 shows that flat plate 58 (less terminating end 84) is not parallel with vertical section 62 but shows that terminating end 84 can be generally parallel to vertical section 62.

Wings 82 are formed integral with spine 80. Each wing 82 is a minor image of the other, and, thus, only one wing 82 is described. Wing 82 has a generally square or rectangular shape but includes a peripheral tab 86, a shoulder indentation 88, and a hole 90. Peripheral tab 86 extends away from spine 80 along a bottom distal corner of wing 82. Shoulder indentation 88 is a cutout along a top edge 92 of wing 82 and can be generally rectangular in shape. Hole 90 is positioned generally below indentation 88 and can be generally circular in shape. Insert molding material (such as some form of plastic) fills in the void spaces defined by shoulder indentation 88 and hole 90 and enables wings 82 to be securely coupled with mounting tab 52. Shoulder indentations 88 and holes 90, thus, are used to couple flat plate 58 with mounting tab 52.

Top side 48 of electrical connector block 34 includes mounting tab 52 which couples with flat plate 58 of elastic clip bracket 50. Tab 52 supports elastic clip bracket 50 during insertion of a portion of bracket 50 in mounting hole 30 of modular wall panel 24. Tab 52 can be integral with electrical connector 34 (as shown in the figures) or, alternatively, can be formed separately from electrical connector 34 and coupled with electrical connector 34. Tab 52 includes a substantially vertical first wall 94, a substantially vertical second wall 96, and substantially horizontal support ledges 98. First wall 94, second wall 96, and support ledges 98 can be integral relative to one another, as shown in the drawings. Alternatively, one or more of the various parts 94, 96, 98 of tab 52 can be formed separately relative to one another and coupled with each other.

First wall 94 is generally perpendicular to second wall 96. First wall 94 extends generally parallel to and co-axial with a longitudinal direction 100 of wireway 32 (shown by double-arrow 100 in FIG. 1). First wall 94 is in general alignment with spine 80 of flat plate 58. First wall 94 includes a first end 102, a second end 104, a tower 106, and a base 108. First end 102 of first wall 94 is positioned nearer to wireway 32 than second end 104 of first wall 94. Second end 104 of first wall 94 couples with second wall 96. Second end 104 can include two transition sections 110 where second end 104 of first wall 94 transitions to second wall 96. Tower 106 is mounted on base 108, which serves as a platform for tower 106. Base 108 is directly connected to top side 48 of electrical connector 34. Base 108 can be narrower near wireway 32 than near second wall 96.

Second wall 96 has a general rectangular shape. Second wall 96 includes a first side 112, a second side 114, a first end 116, and a second end 118. First side 112 couples with second end 104 of first wall 94 and, thus, faces first wall 94 and wireway 32. First side 112 can include two through holes 120 which make flat plate 58 of elastic clip bracket 50 visible after flat plate 58 is insert molded with tab 52. Two through holes 120 can be formed by two support pillars 206 during insert molding, as described below. First side 112 and second side 114 of second wall 96 are interposed in part by flat plate 58; that is, the plane occupied in part by flat plate 58 serves to distinguish first side 112 from second side 114. Regarding the thicknesses of second wall 96, first side 112 can be approximately twice as thick as second side 114.

Second side 114 of second wall 96 can include three cutouts 122, 124, 126 and two planks 128, 130. Three cutouts 122, 124, 126 include a first cutout 122, a second cutout 124, and a third cutout 126. Cutouts 122, 124, 126 expose flat plate 58 to viewing. Two planks 128, 130 include a first plank 128 and a second plank 130. Viewing tab 52 from second side 114 of second wall 96 and proceeding horizontally in a left to right direction (with clip 50 in an upright position), the ordering of cutouts 122, 124, 126 and planks 128, 130 is as follows: first cutout 122, first plank 128, second cutout 124, second plank 130, third cutout 126. That is, first cutout 122 is along first end 116 of second wall 96 and bordered in part by first plank 128. Bordered in part by planks 128, 130, second cutout 124 is in the middle of second side 114, exposing spine 80. Third cutout 126 is along second end 118 of second wall 96 and bordered in part by second plank 130.

Each plank 128, 130 is formed integral with top side 48 of electrical connector 34 and is generally rectangular in shape with a longitudinal direction proceeding substantially vertically. Planks 128, 130 are generally parallel to flat plate 58 and arm 54 (but may or may not be parallel to spine upper terminating end 84). Approximately centered between planks 128, 130 is spine 80 of flat plate 58. Between planks 128, 130 and positioned in second cutout 124 is a platform 132 positioned below and adjacent a portion of U-shaped section 56 of clip bracket 50. Platform 132 can serve as a support for bracket 50. Planks 128, 130 couple with first side 112 of second wall 96 using shoulder indentations 88 and through holes 90 of flat plate 58; this coupling, then, holds flat plate 58 to tab 52.

First and second ends 116, 118 of second wall 96 essentially minor each other. First and second ends 116, 118 accommodate the size and shape of wings 82. More specifically, first and second ends 116, 118 each include a projecting mounting tab 134. Mounting tabs 134 are generally square or rectangular in shape but can assume a variety of sizes and shapes sufficient to support and accommodate the size and shape of peripheral tabs 86 of wings 82.

Support ledges 98 are formed integral with first wall 94 and second wall 96. Support ledges 98 have a generally triangular shape and run from first end 102 of first wall 94 to, respectively, first end 116 of second wall 96 and second end 118 of second wall 96. Support ledges 98 are positioned along upper portions of first and second walls 94, 96. Support ledges 98 include a bottom surface 136. Below support ledges 98 are cutouts 138 defined by bottom surface 136, first wall 94, and first side 112 of second wall 96.

In use, electrical distribution harness assembly 20 mounts to modular wall panel 24, such as rail 22 of modular wall panel 24, using a method which includes the following steps: providing; mounting; and securing. Provided is electrical distribution harness assembly 20 as described above, including electrical connector 34 and elastic clip bracket 50. Electrical connector 34 can further include mounting tab 52 which is integral with electrical connector 34. Mounting tab 52 couples with flat plate 58 of clip bracket 50 and thereby supports clip bracket 50. The mounting step includes mounting mounting end 74 of arm 54 of clip bracket 50 to mounting feature 30 associated with modular wall panel 24. The securing step includes securing mounting end 74 of clip bracket 50 to mounting feature 30. Additionally, the securing step can include using at least one projection 72. While mounting feature 30 is shown in FIG. 1 as a hole, mounting feature 30 can be another type of mounting feature associated with modular wall panel 24, such as a hook.

Providing mounting feature 30 as a hole, mounting end 74 can be mounted to hole 30 by inserting end 74 in mounting hole 30 of rail 22 of modular wall panel 24. Mounting end 74 includes upper curved section 64 of arm 54 and at least one projection 72, which can include a plurality of projections 72. Before or during insertion, arm 54 can be depressed to facilitate insertion into mounting hole 30. That is, arm 54 and/or U-shaped section 56 can be flexed and/or bent such that upper curved section 64 moves in a direction generally towards wireway 32 and/or generally in longitudinal direction 100. During insertion, upper curved section 64, upwardly facing edge 78 of projections 72, and/or other parts of clip bracket 50 can contact rail 22 in hole 30. Mounting end 74 is inserted in hole 30 until bottom edges 76 of projections 72 clear bottom wall 28 of rail 22. After mounting end 74 is inserted into hole 30, arm 54 can snap into place. Upon snapping in place, mounting end 74 is retained, and thus secured, in mounting hole 30. Projections 72 can serve to retain mounting end 74 in mounting hole 30 by resting bottom edges 76 on bottom wall 28 within channel 26 of rail 22. Electrical distribution harness assembly 20 can also include a second electrical connector 34 coupled to wireway 32 at the other end 36 of wireway 32. Elastic clip bracket 50 coupled with second electrical connector 34 can then be inserted and retained in another mounting hole 30 of rail 22 of modular wall panel 24, in a manner as described above. To uninstall clip bracket 50 from rail 22, arm 54 of clip 50 can be depressed so as to clear projections 72 from rail 22, and mounting end 74 then can be withdrawn from mounting hole 30.

The invention in another form is directed to a method of manufacturing electrical distribution harness assembly 20 which is configured for coupling with rail 22 of modular wall panel 24. The method includes the steps of forming and encapsulating. The forming step includes forming elastic clip bracket 50, which is configured for snap-fitting to modular wall panel 24. Elastic clip bracket 50 can have the form as described above. Elastic clip bracket 50 can be formed from a metal blank (such as stainless steel) which is cut, stamped, and/or shaped into the final form.

Figure 5:
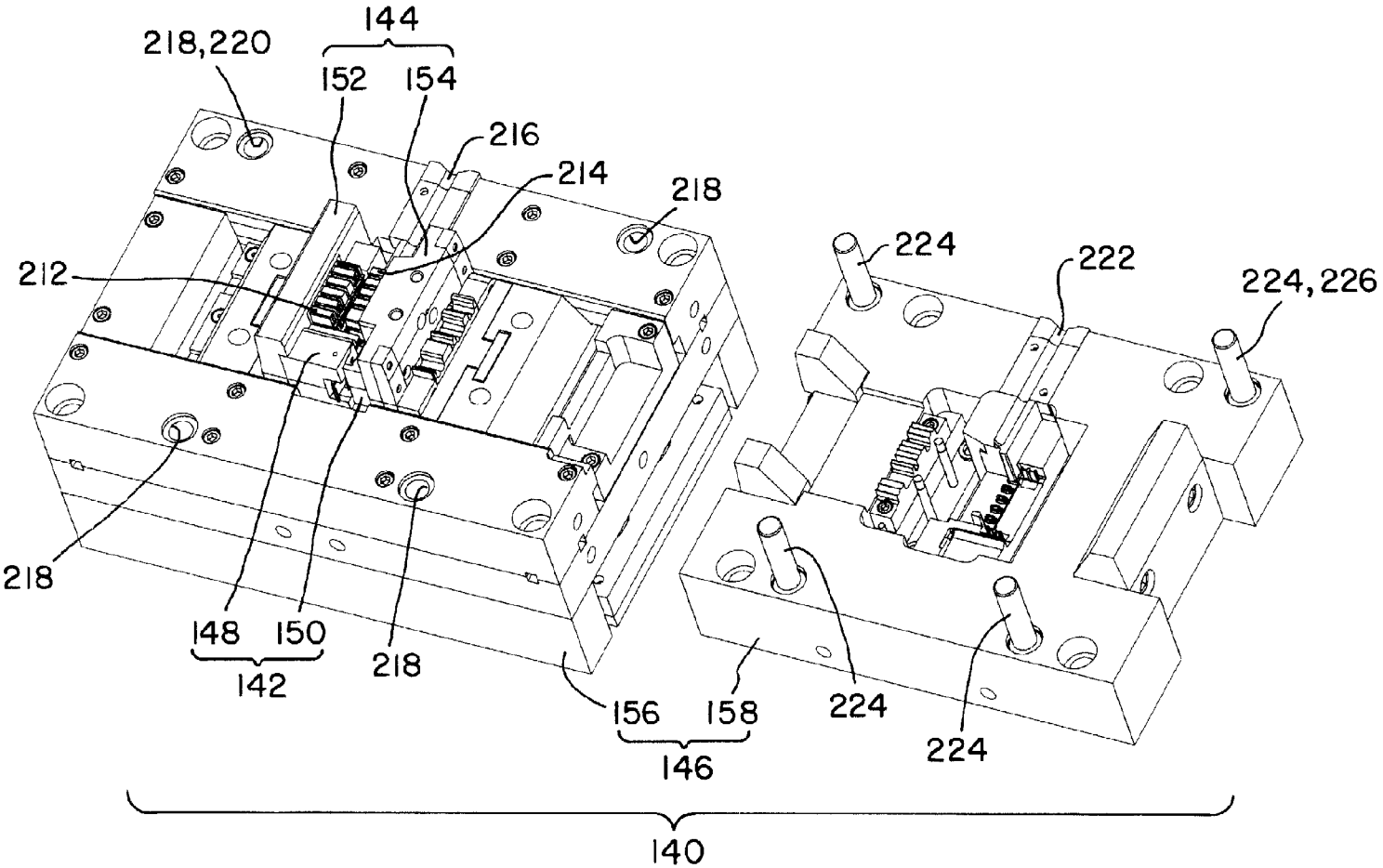
FIG. 5 is a perspective view of the molding assembly according to the present invention.
Figure 7:
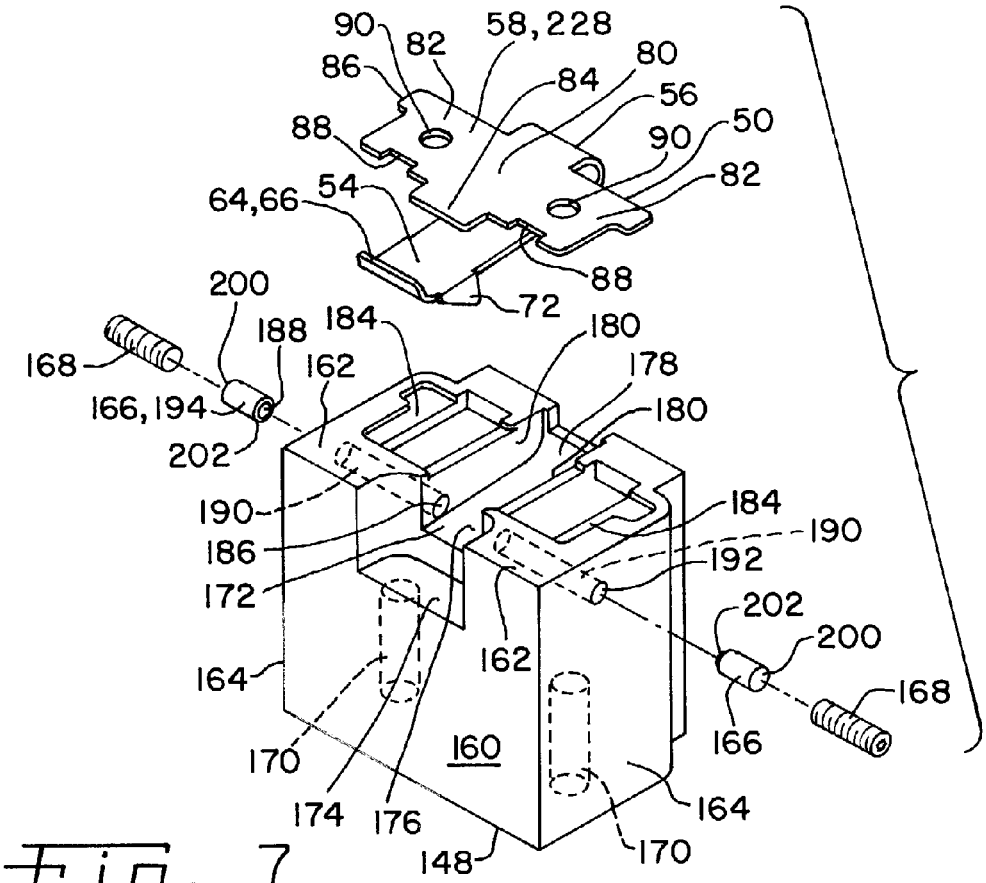
FIG. 7 is an exploded, perspective view of the clip insert and the elastic clip bracket of FIG. 6.

The encapsulating step includes encapsulating at least a portion of elastic clip bracket 50 in electrical connector 34. The encapsulating step can include using an insert molding (overmolding) process such that body 35 of electrical connector 34 is overmolded to include elastic clip bracket 50. That is, clip bracket 50 can be encapsulated by a molding material (such as some form of plastic) during the molding of electrical connector block 34. Electrical connector block 34 can be formed, then, including mounting tab 52 encapsulating clip bracket 50. The encapsulating step, thus, includes providing clip bracket 50 (as described above) and a molding assembly, as shown in FIGS. 5-9. The molding assembly 140 includes a first subassembly 142, a second subassembly 144, and a tool 146 (tool 146 is shown in FIG. 5 as being coupled with first and second subassemblies 142, 144, and second subassembly 144 is shown in FIG. 5 as being coupled with first subassembly 142 and tool 146). First subassembly 142 includes a clip insert 148 and a back-supporting insert 150. Second subassembly 144 includes a first tree 152 and a second tree 154. Tool 146 includes a first tool part 156 and a second tool part 158. Generally, when using molding assembly 140 to form electrical connector block 34 including elastic clip bracket 50 and mounting tab 52, first subassembly 142 holds elastic clip bracket 50, second subassembly 144 holds first subassembly 142, and tool 146 holds both first and second subassemblies 142, 144.

Clip insert 148 of first subassembly 142 is configured to hold, in part, elastic clip bracket 50 during molding. Clip insert 148 includes a top side 160, a front face 162, two opposing exterior sides 164, two ball detent assemblies 166, two backing set screws 168, and a plurality of fastener holes 170 (such as bolt holes) for fastening clip insert 148 to first tree 150 of second subassembly 144. Top side 160 and front face 162 define a well 172 carved out of (generally speaking) clip insert 148.

Well 172 has a geometry shaped to matingly accommodate the geometry of clip bracket 50 when clip bracket 50 is inserted in well 172 prior to molding. Well 172 includes a projection section 174, an arm section 176, a partial U-shaped section 178, two opposing ball detent sides 180, and two wing sections 184. Projection section 174 of well 172 accommodates projections 72 upon insertion of clip bracket 50 in well 172, while upper curved section 64 of arm 54 generally extends above top side 160 and, thus, above projection section 174 upon insertion of clip 50 in well 172. Upon insertion of clip bracket 50 in well 172, arm section 176 of well 172 accommodates arm 54, less projections 72, a section of arm 54 extending between projections 72, and upper curved section 64. Arm section 176 extends down from projection section 174 and is approximately centered between two opposing exterior sides 164. Partial U-shaped section 178 of well 172 partially accommodates U-shaped section 56 of clip bracket 50. As on clip bracket 50, partial U-shaped section 178 extends below arm section 176.

Figure 9:
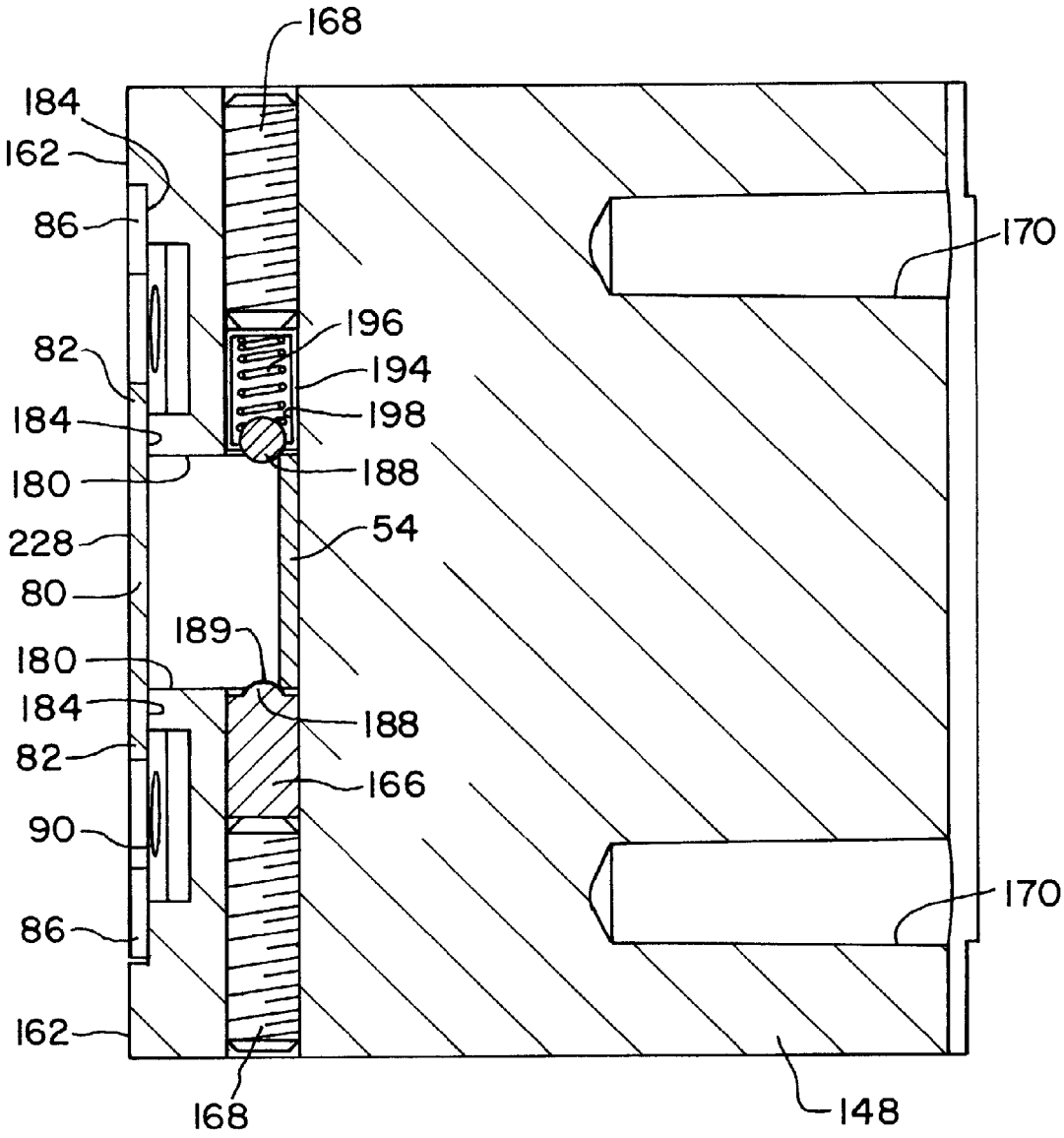
FIG. 9 is a cross-sectional view taken along line 9-9 in FIG. 8, the upper ball detent assembly showing various components of each ball detent assembly.

Two opposing ball detent sides 180 extend down from projection section 174 and are generally perpendicular to arm section 176, which is positioned between two ball detent sides 180. Projecting from an opening 186 in each ball detent side 180 is a spherical ball 188 of a ball detent assembly 166, opening 186 and spherical ball 188 both being positioned near projection section 174 and arm section 176 of well 172. Each opening 186 can accommodate the action of spherical ball 188 of ball detent assembly 166. The shortest distance from arm section 176 to a point 189 on the surface of spherical ball 188 which extends the farthest from a corresponding ball detent side 180 is greater than the thickness of arm 54, as indicated in FIG. 9. Wing sections 184 of well 172 accommodate wings 82 of flat plate 58 upon insertion of clip bracket 50 in well 172; wing sections 184 can be flush with parts of wings 82 (such as at least a part of peripheral tabs 86 of wings 82) and afford gaps between wing sections 184 and other parts of wings 82 when clip bracket 50 is mounted in well 172 of clip insert 148.

Each exterior side 164 is associated with a corresponding threaded hole 190. That is, each exterior side 164 includes an opening 192 to a single threaded hole 190, each threaded hole 190 extending between a respective exterior side 164 to a corresponding ball detent side 180. Each treaded hole 190 runs substantially parallel to top side 160 and perpendicular to a corresponding ball detent side 180.

Each ball detent assembly 166 is positioned along a corresponding ball detent side 180 and is fastened to a corresponding threaded hole 190. Each ball detent assembly is essentially a set screw itself and includes a housing 194, a spherical ball 188, and a spring 196. Housing 194 includes a threaded exterior surface (threads not shown) for threadably engaging threaded hole 190; the threaded exterior surface can be a number 4 thread. Housing 194 also includes a hollow chamber 198, such as a bored cylinder. Chamber 198 can include spherical ball 188 and spring 196 which allows spherical ball 188 to move back-and-forth in a longitudinal direction of chamber 198 when spring 196 is either compressed or released from compression, relatively speaking. Spherical ball 188 can occupy a protrusion position or a retreat position. In the protrusion position, spherical ball 188 can protrude into well 172 some distance away from a corresponding ball detent side 180. When in the protrusion position and pushed (with a compressive force) in a direction from well 172 towards a corresponding exterior side 164, spherical ball 188 compresses spring 196 and retreats into housing 194 and occupies, at that point, a retreat position. When the compressive force is released (relatively speaking), spring 196 moves spherical ball 188 from the retreat position back to the protrusion position. Housing 194 can further include a closed end 200 facing towards a corresponding exterior side 164 and a partially open end 202 facing towards and closely aligned with a corresponding ball detent side 180 of well 172. Closed end 200 can provide a brace for one end of spring 196 and keep spring from exiting housing 194. Another end of spring 196 can contact spherical ball 188. Partially open end 202 of housing 194 can have a diameter less than an inside diameter of housing 194 (which is associated with the diameter of hollow chamber 198) and also less than a diameter of spherical ball 188. Partially open end 202, then, can serve to allow spherical ball 188 to protrude from partially open end 202 while not allowing spherical ball 188 to completely escape housing 194. As such, housing 194 serves to captivate both spring 196 and spherical ball 188. Representations of the components 188, 194, 196, 198 of ball detent assembly 166 are shown in the upper ball detent assembly 166 of FIG. 9, whereas the internal components 196, 198 and an enclosed portion of ball 188 are not shown in bottom ball detent assembly 166 of FIG. 9.

Each backing set screw 168 serves to captivate a corresponding ball detent assembly 166 within a corresponding threaded hole 190. That is, backing set screw 168 is threadably received in threaded hole 190. One end of backing set screw 168 can be virtually flush with exterior side 164, while the other end of backing set screw 168 can be positioned adjacent closed end 200 of housing 194 of ball detent assembly 166.

Back-supporting insert 150 of first subassembly 142 includes a base 204, two pillars 206 connected to base 204, and a plurality of fastener holes (not shown), such as bolt holes, defined in base 204 for fastening back-supporting insert 150 to second tree 154 of second subassembly 144. During molding, back-supporting insert 150 supports elastic clip bracket 50 using pillars 206. Pillars 206 project away from base 204 in a direction generally orthogonal to base 204. Pillars 206 can have a cross-section which assumes different shapes; these shapes include, but are not necessarily limited to, a circle, square, rectangle, star, and triangle. Pillars 206 can be elongated and can taper running from a proximal end 208 connected to base 204 to a distal end 210 (such as a cone) or can taper in the opposite direction. Each pillar 206 can include a longitudinal axis running from proximal end 208 to distal end 210 and through the cross-sectional center of pillars 206. The longitudinal axes of pillars 206 can run substantially parallel relative to one another.

First tree 152 of second subassembly 144 couples with clip insert 148 using holes 170. First tree 152 also includes mold parts 212 for molding electrical connector 34. Second tree 154 of second subassembly 144 couples with back-supporting insert 150 using fastening holes. Second tree 154 also includes mold parts 214 for molding electrical connector 34.

First tool part 156 includes features which permit second subassembly 144, including first subassembly 142 and clip bracket 50, to be matingly placed in first tool part 156. First tool part 156 also includes a first runner half 216 for shooting molten plastic into tool 146 during molding, as well as female bores 218 for coupling first tool part 156 with second tool part 158. Female bores 218 include first female bore 220. Second tool part 158 also includes features which mate with first and second subassemblies 142, 144 and clip bracket 50. Second tool part 158 further includes a second runner half 222 which forms a complete runner with first runner half 216 when first and second tool parts 156, 158 are coupled together. Second tool part 158 further includes male posts 224 for being inserted in female bores 218 when coupling first tool part 156 with second tool part 158. Male posts 224 includes first male post 226. When coupling first tool part 156 with second tool part 158, first male post 226, for example, is inserted in first female bore 220.

In manufacturing harness 20 including electrical connector block 34 and clip bracket 50, clip insert 148 is mounted to first tree 152 using fasteners, such as bolts, and holes 170. Back-supporting insert 148 is mounted to second tree 154 using fasteners, such as bolts, and fastening holes. Clip bracket 50 can then be inserted in well 172 of clip insert 148, arm 54 and projections 72 leading clip bracket 50 in a direction of insertion 230 into well 172.

When inserting clip bracket 50 in well 172, arm 54 (particularly longitudinal sides 60 of arm 54) depresses spherical balls 188 of ball detent assemblies 166 into the retreat position, or at least into a partial retreat position. Clip bracket 50 is inserted into well 172 until the material thickness of arm 54 passes beyond spherical balls 188 and arm 54 seats in arm section 176 of well 172. In the material thickness of arm 54 passing beyond spherical balls 188, arm 54 may not completely clear spherical balls 188 but does go at least beyond point 189 on the surface of each spherical ball 188. The remaining parts of clip bracket 50 (i.e., projections 72, U-shaped section 56, wings 82) also seat in corresponding parts of well 172 (i.e., projection section 174, partial U-shaped section 178, wing sections 184). That is, after insertion of clip bracket 50 in well 172, at least a part of arm 54, a part of U-shaped section 56, and parts of flat plate 58 are substantially flush with corresponding sides of well 172. Additionally, after insertion of clip bracket 50 in well 172, a plane defined by a rear side 228 of flat plate 58 can be substantially coplanar with a plane defined by front face 162 of clip insert 148, where rear side 228 includes spine 80 and wings 82; however, according to one embodiment of the present invention, spine terminating end 84 may not be coplanar relative to front face 162, as spine terminating end 84 may not be completely planar relative to remaining portions of flat plate 58 and may extend toward arm 54 (as shown in FIGS. 8-9). Upon seating clip bracket 50 in well 172, spherical balls 188 snap back to a protrusion position under spring loaded pressure from spring 196. In the protrusion position, spherical balls 188 rest substantially behind arm 54; that is, the distance between points 189 of spherical balls 188 is less than the distance between longitudinal sides 60 of arm 54. Ball detent assemblies 166, thus, allow the insertion and seating of clip bracket 50 into well 172 and also hinder arm 54 from moving after insertion and seating. As a result, ball detent assemblies 166 support and help to hold elastic clip bracket 50 in well 172 during insert molding, and thus help to keep clip bracket 50 from falling out of insert clip 148.

Back-supporting insert 150 and clip insert 148 are then brought together to clasp elastic clip bracket 50 between inserts 148, 150. More specifically, upon inserting and seating elastic clip bracket 50 in well 172 of clip insert 148, distal ends 210 of pillars 206 of back-supporting insert 150 are placed and/or pressed against smooth rear side 228 of back plate 58 so as to clasp and support clip bracket 50 between insert clip 148 and back-supporting insert 150 during insert molding of electrical connector 34. The clasping of clip bracket 50 using back-supporting insert 150 serves to stabilize and prevent movement of clip 50 during insert molding. Distal ends 210 of pillars 206 are not placed in holes 90 of wings 82 of flat plate 58, since plastic is to fill holes 90 during molding. When molding tab 52, through holes 120 are formed by pillars 206.

First tree 152 and second tree 154, including first subassembly 142 clasping elastic clip bracket 50, are then inserted in first tool part 156. Second tool part 158 is then mated with first tool part 156, as well as first and second trees 152, 154 and elastic clip bracket 50. In so doing, first male post 226 of second tool part 158 is inserted in first female bore 220 of first tool part 156 and tool 146 is closed. Molten plastic is shot into tool 146 along the runner (made up of runner halves 216, 222). In performing the molding process, molten plastic flows through holes 90 and over shoulder indentations 88 of flat plate 58 of clip bracket 50 and subsequently solidifies. In so doing, elastic clip bracket 50 is secured to mounting tab 52 of electrical connector 34. The injection insert molding process continues until the finished part—electrical connector block 34 including clip bracket 50 and mounting tab 52—is manufactured.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution harness assembly configured for coupling with a modular wall panel, said electrical distribution harness assembly comprising:

at least one electrical connector including a body and an elastic clip bracket configured for snap-fitting to the modular wall panel, said body forming an overmolded connection with said elastic clip bracket.

2. The electrical distribution harness assembly of claim 1, wherein said elastic clip bracket includes at least one projection configured for coupling said elastic clip bracket with the modular wall panel.

3. The electrical distribution harness assembly of claim 2, wherein said at least one projection includes a plurality of projections, each of said plurality of projections having a shape which is at least one of triangular, square, and rectangular.

4. The electrical distribution harness assembly of claim 3, wherein said elastic clip bracket includes an arm which includes a first longitudinal side and a second longitudinal side, said plurality of projections including a first projection and a second projection, said first longitudinal side coupled with said first projection, said second longitudinal side coupled with said second projection.

5. The electrical distribution harness assembly of claim 2, wherein said elastic clip bracket includes a first curved section configured for being inserted in a mounting hole of the modular wall panel, said first curved section positioned above and proximate said at least one projection.

6. The electrical distribution harness assembly of claim 1, wherein said elastic clip bracket includes an arm, a flat plate, and a second curved section coupling said arm and said flat plate.

7. The electrical distribution harness assembly of claim 1, wherein said at least one electrical connector includes a tab coupled with said elastic clip bracket and configured for supporting said elastic clip bracket during insertion of a portion of said elastic clip bracket in a mounting hole of the modular wall panel.

8. The electrical distribution harness assembly of claim 7, wherein said tab is integral with said at least one electrical connector and includes a substantially vertical first wall and a substantially vertical second wall generally perpendicular to said first wall.

9. The electrical distribution harness assembly of claim 8, wherein said elastic clip bracket includes a flat plate which includes at least one hole and at least one shoulder indentation, said at least one hole and said at least one shoulder indentation being used to couple said flat plate with said tab.

10. A method of mounting an electrical distribution harness assembly to a modular wall panel, said method comprising the steps of:

providing at least one electrical connector including an body and an elastic clip bracket, said body forming an overmolded connection with said elastic clip bracket;

mounting an end of said elastic clip bracket to a mounting feature associated with the modular wall panel; and securing said end of said elastic clip bracket to said mounting feature.

11. The method of mounting of claim 10, wherein said step of securing includes using at least one projection.

12. The method of mounting of claim 11, wherein said elastic clip bracket includes an arm which includes a first longitudinal side and a second longitudinal side and said at least one projection includes a plurality of projection including a first projection and a second projection, said first longitudinal side coupled with said first projection, said second longitudinal side coupled with said second projection.

13. The method of mounting of claim 10, further comprising the step of supporting said elastic clip bracket using a tab which is integral with said at least one electrical connector.

14. The method of mounting of claim 13, wherein said elastic clip bracket includes an arm, a flat plate, and a curved section coupling said arm and said flat plate, said flat plate coupled with said tab.

15. The method of mounting of claim 14, wherein said flat plate includes at least one hole and at least one shoulder indentation, said at least one hole and said at least one shoulder indentation being used to couple said flat plate with said tab.

* * * * *

UNITED STATES PATENT AND TRADEMARK OFFICE

CERTIFICATE OF CORRECTION

PATENT NO. : 7,690,934 B2
APPLICATION NO. : 12/609433
DATED : April 6, 2010
INVENTOR(S) : Ray H. Riner It is certified that error appears in the above-identified patent and that said Letters Patent is hereby corrected as shown below:

COLUMN 6

At line 25, please delete "minor"; and substitute therefore --mirror--.

Signed and Sealed this

Twenty-seventh Day of July, 2010

David J. Kappos

David J. Kappos
*Director of the United States Patent and Trademark Office*